US007735984B2

(12) United States Patent
Iijima et al.

(10) Patent No.: US 7,735,984 B2
(45) Date of Patent: Jun. 15, 2010

(54) LIQUID CONTAINER

(75) Inventors: Yasushi Iijima, Tokyo (JP); Shogo Kawamura, Numazu (JP); Yasuo Kotaki, Yokohama (JP); Ryoji Inoue, Kawasaki (JP); Hideki Ogura, Yokohama (JP); Tetsuya Ohashi, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 673 days.

(21) Appl. No.: 11/798,056

(22) Filed: May 10, 2007

(65) Prior Publication Data

US 2007/0263052 A1 Nov. 15, 2007

(30) Foreign Application Priority Data

May 11, 2006 (JP) ..... 2006-133048

(51) Int. Cl.
*B41J 2/175* (2006.01)

(52) U.S. Cl. ..... 347/86; 347/87

(58) Field of Classification Search ..... 347/85, 347/86, 87; 399/237, 238
See application file for complete search history.

(56) References Cited

U.S. PATENT DOCUMENTS

| | | | | |
|---|---|---|---|---|
| 3,876,282 | A * | 4/1975 | Schon et al. | 399/238 |
| 6,823,161 | B2 * | 11/2004 | Cho et al. | 399/237 |
| 2007/0263025 | A1 | 11/2007 | Ohashi et al. | 347/19 |
| 2007/0263048 | A1 | 11/2007 | Okito et al. | 347/85 |
| 2007/0291076 | A1 | 12/2007 | Seki et al. | 347/37 |
| 2007/0291077 | A1 | 12/2007 | Seki et al. | 347/37 |

FOREIGN PATENT DOCUMENTS

| | | |
|---|---|---|
| JP | 2004-216761 | 8/2004 |
| JP | 2005-66520 | 3/2005 |

* cited by examiner

*Primary Examiner*—Anh T. N. Vo
(74) *Attorney, Agent, or Firm*—Fitzpatrick, Cella, Harper & Scinto

(57) ABSTRACT

An ink tank includes two stirring members having different masses in an ink containing chamber. The two stirring members are moved by an inertial force according to movement of a carriage and stir ink. The two stirring members have different movement start times and movement speeds.

11 Claims, 17 Drawing Sheets

LIQUID CONTAINER

BACKGROUND OF THE INVENTION

1. Field of the Invention

The present invention relates to a liquid container that stores various liquids, such as ink and the like, and uniformizes the components of the liquid. In particular, the invention relates to a liquid container that is suitably used as an ink tank containing pigment ink for an ink jet printing apparatus.

2. Description of the Related Art

There is known an ink jet printing apparatus that performs printing by using pigment ink. The pigment ink contained in an ink tank is supplied from the ink tank to the ink jet printing apparatus that can eject ink. In the pigment ink, a pigment is used as a colorant, and the pigment is dispersed in an ink solvent.

A printing medium on which an image is printed by using the pigment ink has excellent light resistance and water resistance. In the pigment ink, the pigment itself is dispersed in the ink solvent as particles. Accordingly, when an ink tank (liquid container) that contains the pigment ink is left standing for many hours, the pigment in the pigment ink settles in the solvent. For example, when a printing apparatus having mounted thereon the ink tank is left standing for many hours, the pigment particles settle at the bottom surface of the ink tank. At this time, there is a concentration gradient of pigment particle from a high concentration portion at the bottom of the ink tank to a low concentration portion at the top thereof. In this state, when the pigment ink is supplied from the ink tank to print an image, the pigment concentration of the pigment ink to be supplied is ununiform, and density unevenness may occur in the printed image. Further, when the pigment ink having extremely high pigment concentration is supplied to a printing head, the coagulated pigment may be clogged in a flow passage of the printing head, and the ink cannot be ejected from the printing head.

In respect to a method that uniformizes the pigment concentration of the pigment ink in the ink tank, and homogenizes the pigment ink, Japanese Patent Laid-Open No. 2005-066520 suggests an ink tank that has a stirring member therein. The ink tank is mounted on a carriage in a serial scan type ink jet printing apparatus and reciprocates along with the carriage during a printing operation. The stirring member, which is provided in the ink tank, operates to stir the pigment ink in the ink tank using an inertial force generated when the ink tank reciprocates along with the carriage.

As such, when the stirring member carries out the stirring operation using the inertial force according to the reciprocation of the carriage, stirring of the pigment ink is quickly performed in a movement direction of the carriage in which the stirring member relatively easily moves. In Japanese Patent Laid-Open No. 2004-216761, a stirring member that operates in the same direction as the movement direction of the carriage is disclosed. However, it is necessary to provide an additional stirring member with respect to a direction perpendicular to the movement direction of the carriage.

A plurality of ink tanks, which are used in the serial scan type ink jet printing apparatus, are mounted on the carriage so as to be parallel to the movement direction of the carriage. For the sake of multicolor printing, various kinds of tanks need to be mounted on the carriage. In this case, while the width of the ink tank is set narrow in the movement direction of the carriage, the width of the ink tank is set wide in the direction crossing the movement direction of the carriage. Accordingly, in respect to the direction crossing the movement direction of the carriage, convection of the pigment ink is rarely generated.

SUMMARY OF THE INVENTION

The present invention provides a liquid container that can actively generate a flow for efficiently stirring a liquid, such as pigment ink or the like, contained therein.

In the first aspect of the present invention, there is provided a liquid container that is detachably mounted on a carriage, which reciprocates in a direction crossing a feed direction of a printing medium, the liquid container comprising: a case; a liquid containing chamber that contains a liquid therein; a plurality of support portions that is provided in the case to be arranged in the liquid containing chamber; and a plurality of stirring members, each of which has one end supported by a corresponding one of support portions and the other end as a free end, wherein at least two of the plurality of stirring members are arranged in a direction crossing a movement direction of the carriage, and at least two of stirring mechanisms, each of which has the support portion and the stirring member corresponding to the support portion, have different structures.

In the second aspect of the present invention, there is provided a liquid container that is detachably mounted on a carriage, which reciprocates in a direction crossing a feed direction of a printing medium, the liquid container comprising: a case; a liquid containing chamber that contains a liquid therein; a supply port that supplies the liquid in the liquid containing chamber to the outside; support portions that are provided in the case to be arranged in the liquid containing chamber; and a plurality of stirring members, each of which has one end supported by a corresponding one of support portions and the other end as a free end, wherein at least two of the plurality of stirring members are arranged in a direction crossing the moving direction of the carriage, and when an inertial moment to be applied to each of the stirring members according to the movement of the carriage is In and a maximum surface area of each of the stirring members subject to an inertial force is Sn, at least two stirring members have different ratios In/Sn.

In the third aspect of the present invention, there is provided a liquid container that is detachably mounted on a carriage, which reciprocates in a direction crossing a feed direction of a printing medium, the liquid container comprising: a case; a liquid containing chamber that contains a liquid therein; a supply port that supplies the liquid in the liquid containing chamber to the outside; support portions that are provided in the case to be arranged in the liquid containing chamber; and a plurality of stirring members, each of which has one end supported by a corresponding one of the support portions and the other end as a free end, wherein at least two of the plurality of stirring members are arranged in a direction crossing the moving direction of the carriage, and at least two of the plurality of stirring members have different movement states according to an inertial force.

According to the aspects of the invention, when a plurality of stirring members in the liquid container move by the inertial force according to the movement of the carriage, the individual stirring members make different moves. As a result, the flow of the liquid can be actively generated between the stirring members. With the flow of the liquid generated between the stirring members, a difference in concentration distribution of the liquid in the liquid container can be improved.

Further features of the present invention will become apparent from the following description of exemplary embodiments (with reference to the attached drawings).

DESCRIPTION OF THE EMBODIMENTS

Embodiments of the invention will now be described with reference to the drawings.

First Embodiment

A liquid container of this embodiment is an ink tank, which contains pigment ink, for a serial scan type ink jet printing apparatus.

Figure 11:
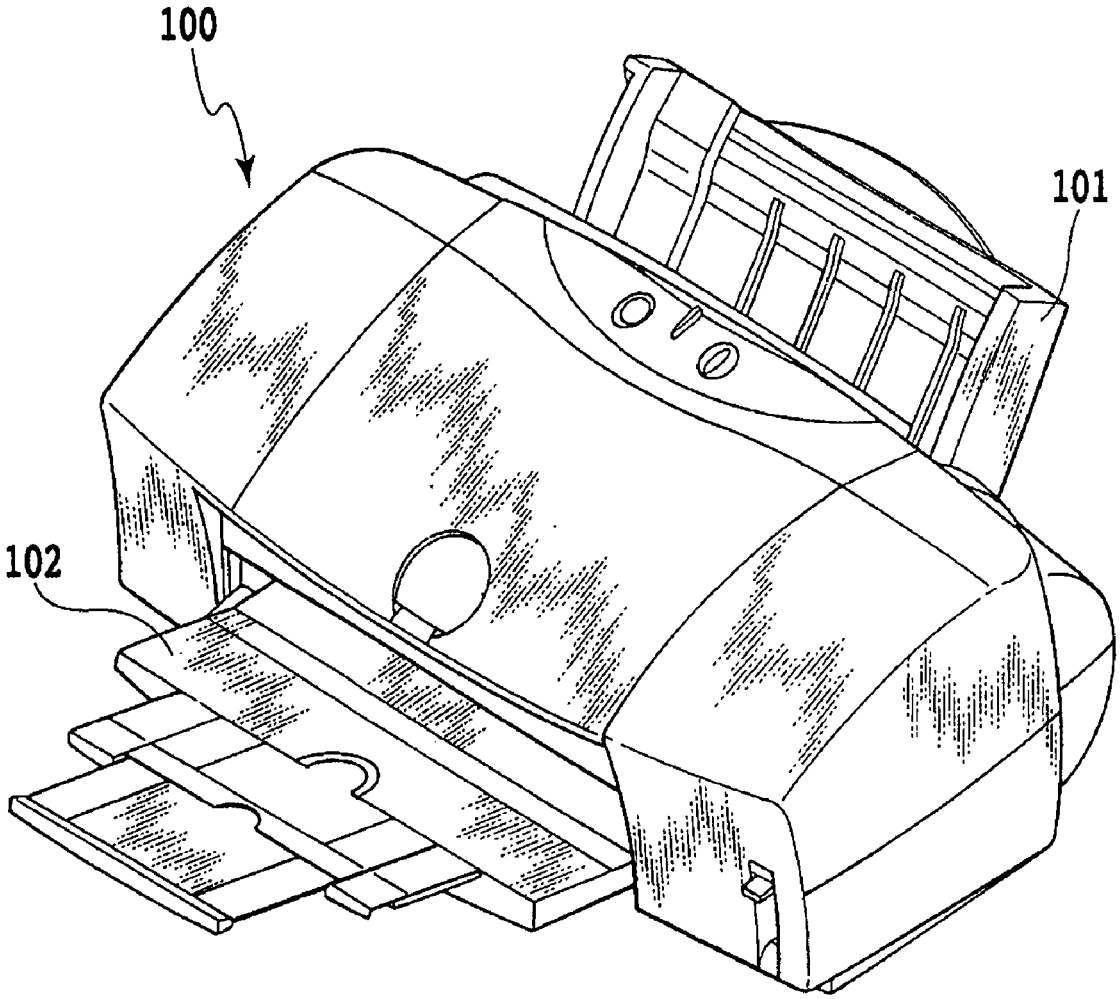
FIG. 11 is a perspective view of an ink jet printing apparatus, to which an ink tank according to an embodiment of the invention can be applied.
Figure 12:
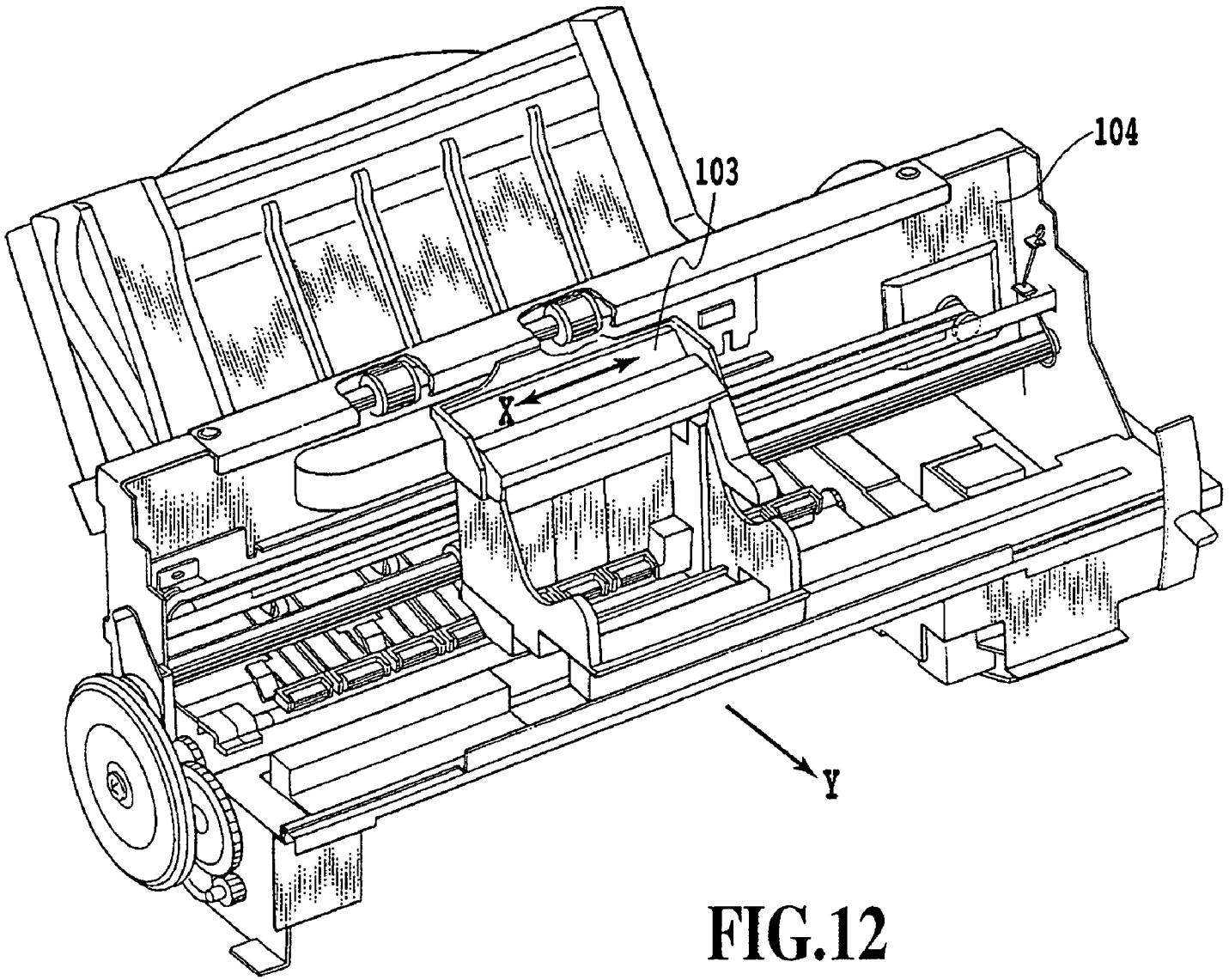
FIG. 12 is a perspective view illustrating the internal configuration of an ink jet printing apparatus.

FIG. 11 is a perspective view of such an ink jet printing apparatus. The printing apparatus includes an apparatus main body 100, a feed unit 101, and a discharge tray 102. In the apparatus main body, as shown in FIG. 12, a chassis 104 and various printing operation mechanisms are provided. A printing head cartridge (not shown) is detachably mounted on a carriage 103, which moves in a main scanning direction (a direction of an arrow X), to perform printing on a printing medium.

Upon printing, the printing head cartridge moves in the main scanning direction along with the carriage and ejects ink from a printing head.

Figure 1:
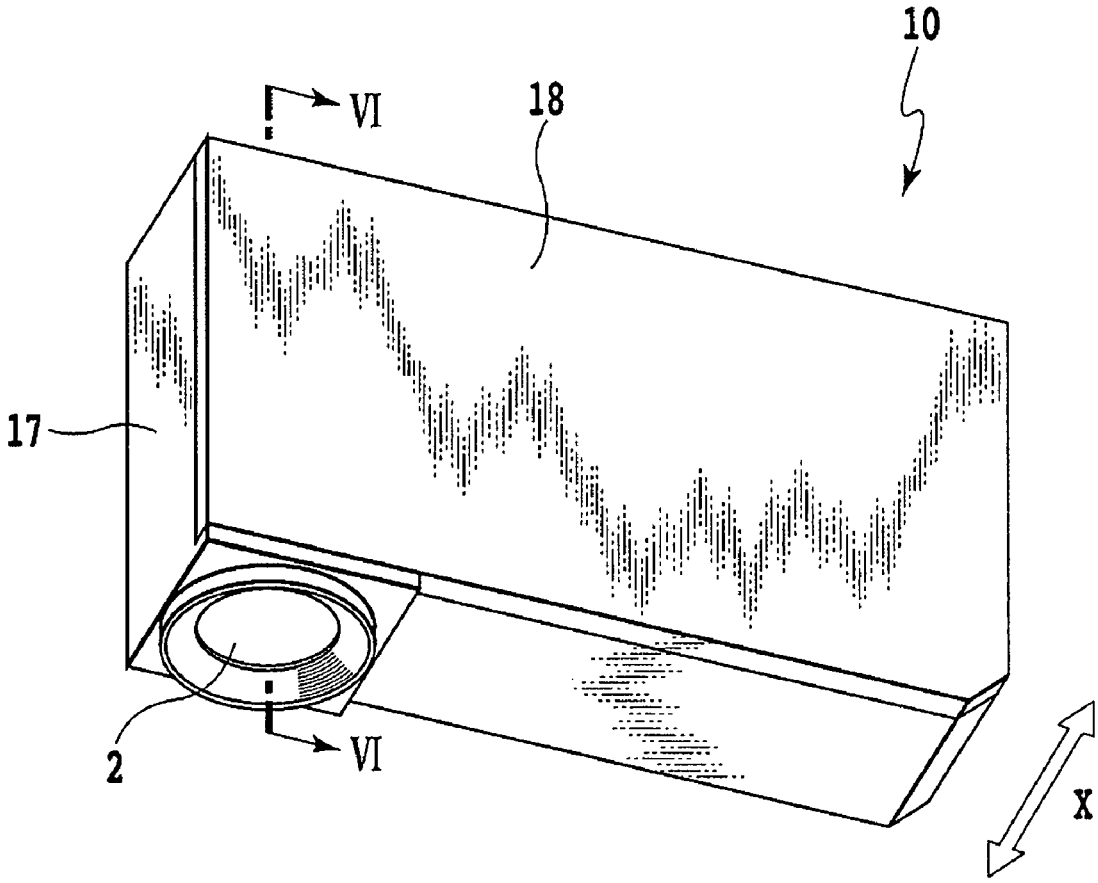
FIG. 1 is a perspective view of an ink tank according to a first embodiment of the invention.

FIG. 1 is a perspective view of an ink tank 10 that constitutes a printing head cartridge together with a printing head. The ink tank of this embodiment includes a container main body 17 and a cover member 18. A containing chamber is formed in the ink tank to contain pigment ink. At the bottom surface of the ink tank 10, an ink supply port 2 is formed to supply ink contained therein to the printing head.

Figure 2:
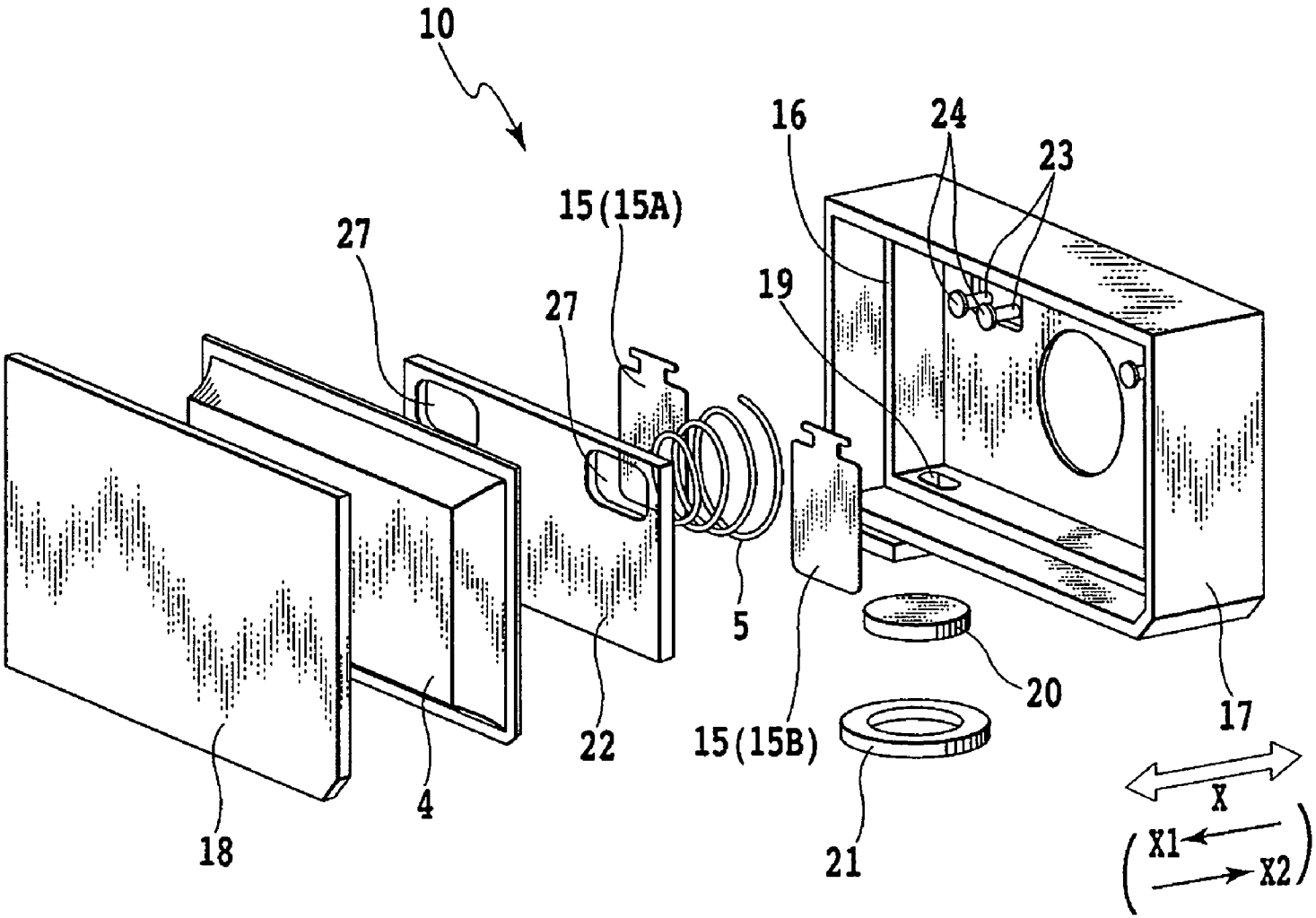
FIG. 2 is an exploded perspective view of the ink tank according to the first embodiment of the invention.
Figure 3:
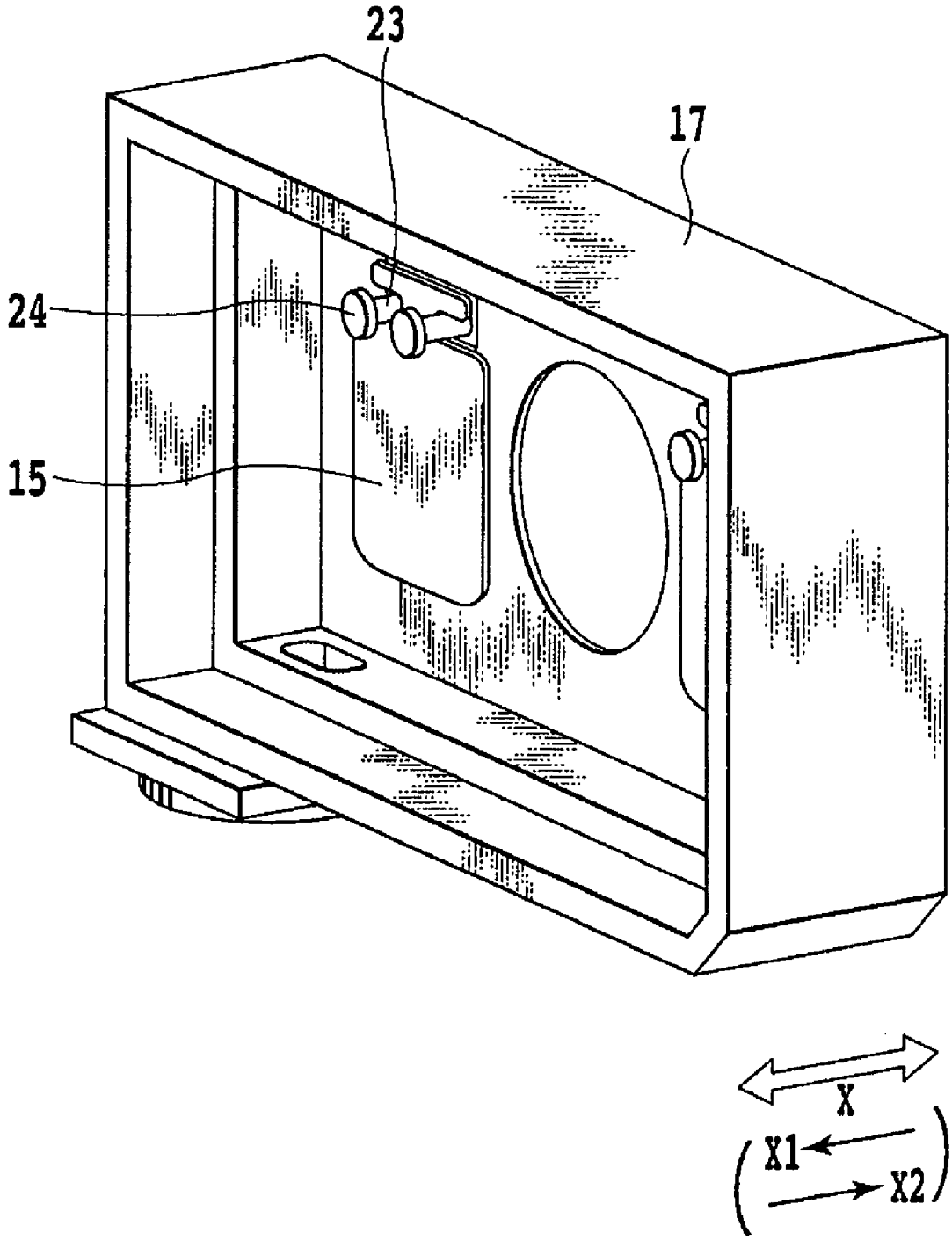
FIG. 3 is a perspective view illustrating the inside of the ink tank according to the first embodiment of the invention.

FIG. 2 is an exploded perspective view of the ink tank 10. The container main body 17 is provided with a spring member 5, a plate member 22, a flexible film 4, a meniscus forming member 20, a pressing plate 21, and stirring members 15. FIG. 3 is a perspective view of the container main body 17 to which the stirring members 15 are attached.

The container main body 17 is formed of, for example, polypropylene. The meniscus forming member 20 is provided in the ink supply port 2 at the bottom of the container main body 17. Further, the pressing member 21 is attached to the ink supply port 2 outside the meniscus forming member 20. The meniscus forming member 20 is a capillary member formed of a textile material, such as polypropylene and having a capillary force, or a combination of the capillary member and a filter member (a hole diameter of approximately 10 to 50 μm). The meniscus forming member 20 communicates with an ink containing chamber (described below) in the container main body 17 by an ink flow passage 19, and forms a meniscus of ink so as to prevent air bubbles from entering the ink containing chamber from the outside.

Figure 6A:
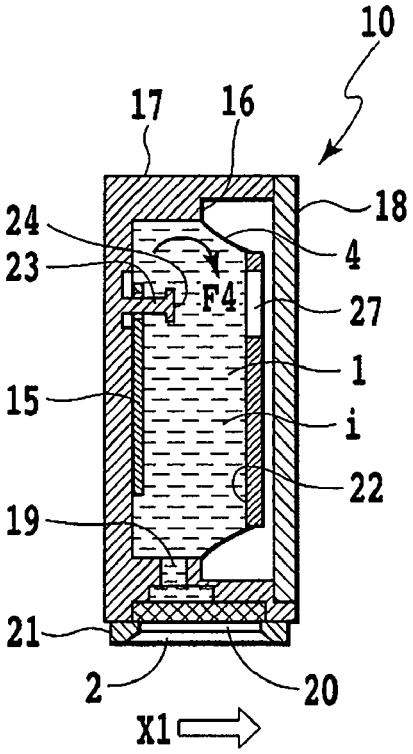
FIG. 6A is a cross-sectional view illustrating the operation of the stirring member when the ink tank moves in one direction.

In the container main body 17, the periphery of the flexible film 4 is welded to an opening peripheral portion 16, thereby forming an ink containing chamber 1 (see FIG. 6A) for containing pigment ink i (see FIG. 6A). The flexible film 4 is a film member (a thickness of approximately 20 to 100 μm) including a thin film formed of polypropylene. The flexible film 4 is urged outward by the spring member 5 through the plate member 22, such that a negative pressure is generated in the ink containing chamber 1. The spring member 5 and the plate member 22 are formed of, for example, a stainless steel material. The cover member 18 is attached to an opening of the container main body 17. The cover member 18 protects the flexible film 4 that is convex outward from the ink containing chamber 1. The cover member 18 is provided with an air communicating port (not shown), and the outside of the ink containing chamber 1 in the container main body 17 is at an atmospheric pressure.

If ink in the ink containing chamber 1 is consumed according to the supply to the printing head, the spring member 5 contracts, the flexible film 4 is bent, and the volume of the ink containing chamber 1 is decreased. The plate member 22 is provided with an opening 27 to avoid interference with support members described below. Accordingly, ink in the ink containing chamber 1 can be consumed until the plate member 22 comes into contact with the inner wall of the container main body 17.

Next, a stirring mechanism of ink in the ink tank of this embodiment will be described.

Figure 5:
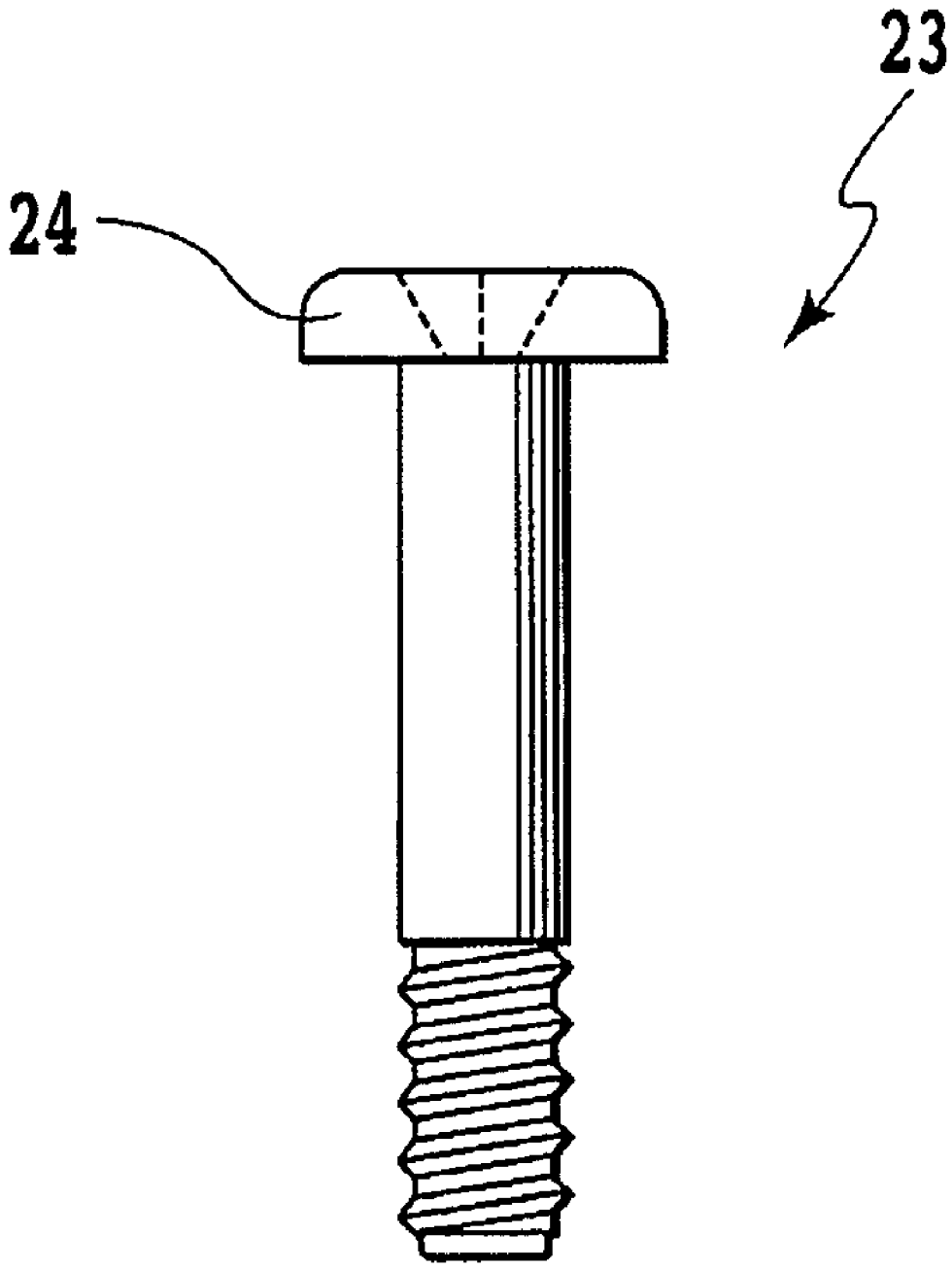
FIG. 5 is a front view of a support member.

A stirring mechanism is provided in the ink containing chamber 1 to stir ink. The stirring mechanism of this embodiment includes support members 23, which are provided at the inner wall of the container main body 17, and the stirring member 15. The support member 23 supports one end of the stirring member 15. Each of the support members 23 is provided with a shaft that is parallel to the main scanning direction, in which the carriage 101 moves, and a retaining portion 24. Like this embodiment, when the container main body 17 is formed of a resin material, the support member 23 may be a boss that is formed integrally with the container main body 17. In this case, a front end of the boss can be widened by a thermal processing, such that the boss is in a rivet shape having the retaining portion 24 at its front end. Further, as shown in FIG. 5, the support member 23 may be a screw member having a head portion. When a screw portion at the front end of the screw member is inserted into the container main body 17, the head portion can function as the retaining portion 24.

Figure 4A:
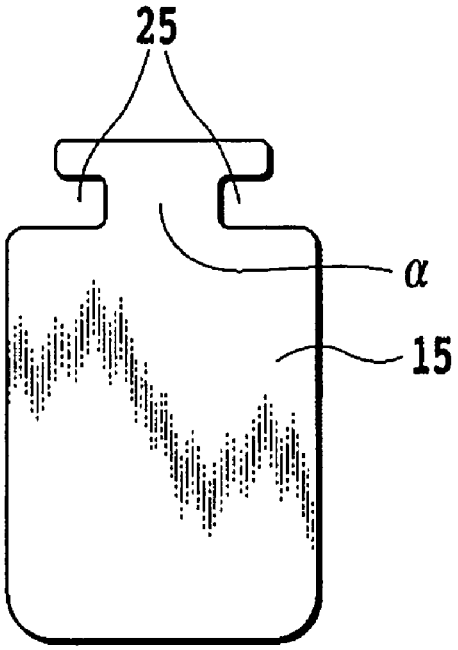
FIG. 4A is a front view of a stirring member.
Figure 4B:
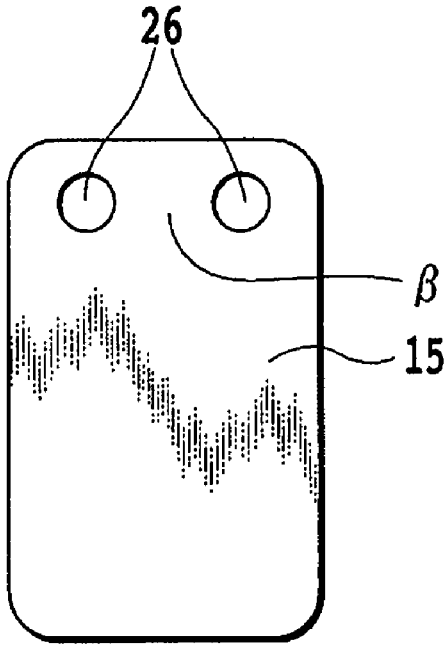
FIG. 4B is a front view illustrating a modification of the stirring member.

For example, the stirring member 15 can be formed as shown in FIG. 4A or 4B. The stirring member 15 of FIG. 4A is a plate member that has concave portions 25 formed at its ends to be engaged with the support members 23. The stirring member 15 of FIG. 4B is a plate member that has holes 26 formed at its ends to be engaged with the support members 23. The stirring members 15 (15A and 15B in FIG. 2) are formed of, for example, a stainless steel material.

Each of the support members 23 is provided with the retaining portion 24 to form a gap to such a degree as to allow the movement of the stirring member 15 in a thickness direction of the stirring member 15. Further, the shafts of the support members 23 are engaged with the concave portions 25 or the holes 26 of the stirring member 15 with a space, and a gap is formed therebetween. The two support members 23 hold a portion a of the stirring member 15 located between the two concave portions 25 shown in FIG. 4A, to thereby support the stirring member 15. Alternatively, the two support members 23 hold a portion β of the stirring member 15 located between the two holes 26 shown in FIG. 4B, to thereby support the stirring member 15.

In this embodiment, the two support members 23 are provided horizontally along the main scanning direction to be parallel to each other. Accordingly, when the stirring member 15 rotates along the main scanning direction, a rotation center axis is determined in a portion where the stirring member 15 and the support members 23 are engaged with each other. With the rotation of the stirring member 15 about the axis, ink is effectively stirred. If the support member 23 is one rod-shaped member, the stirring member 15 is supported at a point. In this case, the movement of the stirring member 15 in all directions is freely performed about the supporting point, and the rotation axis, about which the stirring member 15 rotates along the main scanning direction, is not determined. For this reason, when an inertial force acts on the stirring member 15 in the main scanning direction, the stirring member 15 moves in a posture having an angle not subject to resistance of ink, and thus ink is not sufficiently stirred. Here, the main scanning direction is an X direction shown in FIG. 3, that is, a movement direction of the carriage.

In such a manner, one end of the stirring member 15 is supported on the container main body 17 by the support members 23. Accordingly, the stirring member 15 freely moves linearly along an axial direction of the support members 23, and also freely rotates about the engagement portion with the support members 23 in the main scanning direction.

FIGS. 6A to 6D are cross-sectional views illustrating the basis operation of the stirring member 15 according to the movement of the carriage. FIGS. 6A to 6D are cross-sectional views taken along the line VI-VI of FIG. 1. FIGS. 7A to 7D are perspective views illustrating the basis operation of the stirring member 15. In these drawings, the stirring member 15 has the structure shown in FIG. 4A. The stirring member 15 having the structure shown in FIG. 4B operates in the same manner.

Figure 7A:
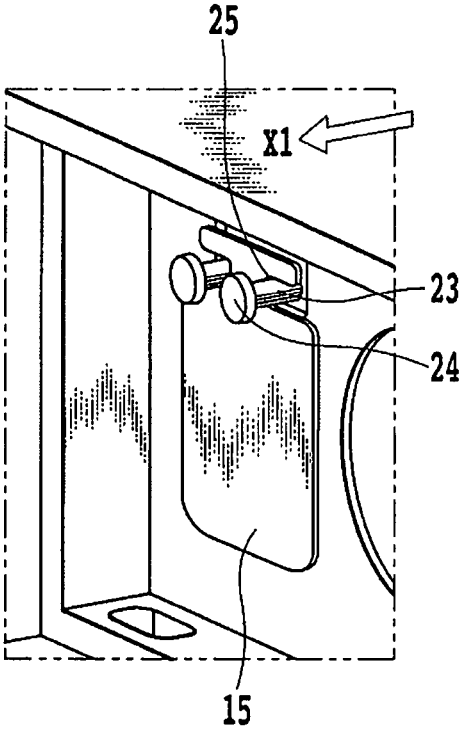
FIG. 7A is an enlarged perspective view illustrating the operation of the stirring member when the ink tank moves in one direction.

FIGS. 6A and 7A show a first state of the stirring member 15. When the ink tank 10 moves in a direction of an arrow X1 according to reciprocation of the carriage 103 in the main scanning direction, as shown in FIGS. 6A and 7A, the stirring member 15 in the ink containing chamber 1 is pressed against the inner wall of the container main body 17 by the inertial force.

Figure 6B:
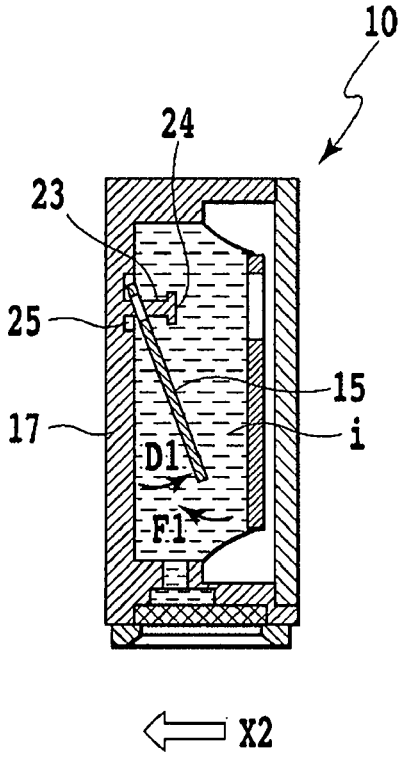
FIG. 6B is a cross-sectional view illustrating the operation of the stirring member when the ink tank moves in the other direction.
Figure 7B:
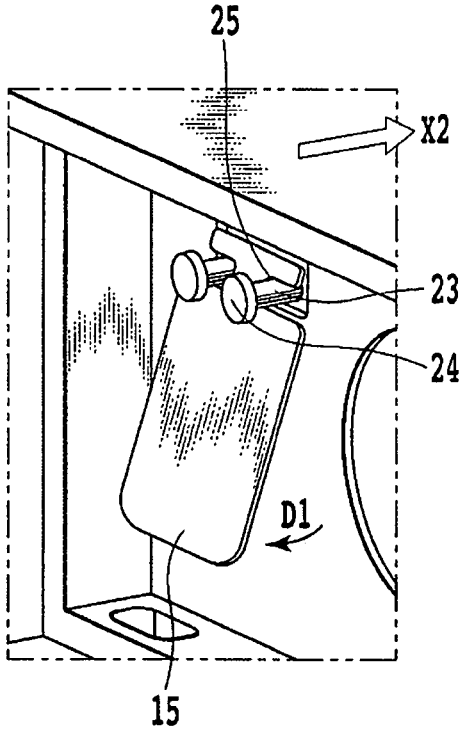
FIG. 7B is an enlarged perspective view illustrating the operation of the stirring member when the ink tank moves in the other direction.

FIGS. 6B and 7B show a second state of the stirring member 15. Since the carriage 103 reciprocates in a range of a printing width of an image, the movement direction thereof changes from the direction of the arrow X1 to a direction of an arrow X2 at a position corresponding to the printing width. With the inertial force at that time, as shown in FIGS. 6B and 7B, the free end of the stirring member 15 rotates about the support member 23 in a direction of an arrow D1 along the main scanning direction. The rotation is allowed in a range of the gap between the concave portion 25 of the stirring member 15 and the shaft of the support member 23. If the free end of the stirring member 15 is separated from the container main body 17, ink i flows into between the stirring member 15 and the container main body 17 as indicated by an arrow F1.

Figure 6C:
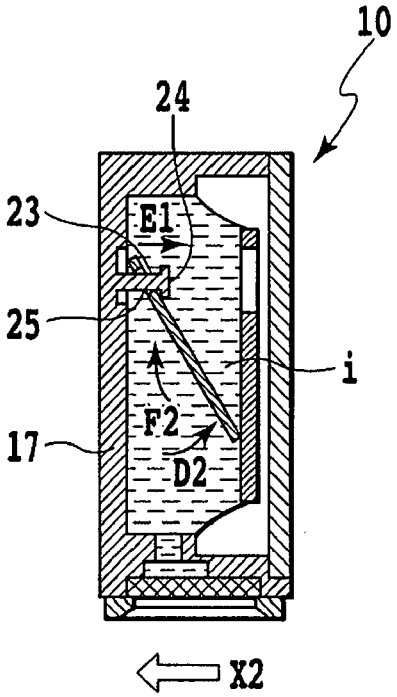
FIG. 6C is a cross-sectional view illustrating the operation of the stirring member when the ink tank moves in the other direction.
Figure 7C:
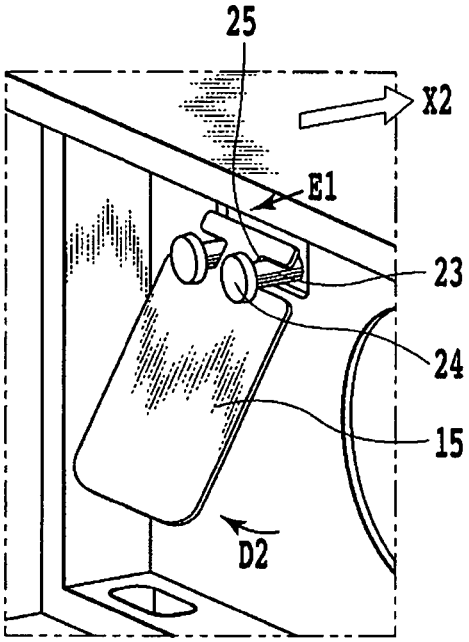
FIG. 7C is an enlarged perspective view illustrating the operation of the stirring member when the ink tank moves in the other direction.

FIGS. 6C and 7C show a third state of the stirring member 15. If the ink tank 10 further moves in the direction of the arrow X2 along with the carriage 103, the end of the stirring member 15 near the support member also starts to move by the inertial force. Accordingly, the entire stirring member 15 moves in a direction of an arrow E1 along the shaft of the support member 23. Then, as shown in FIGS. 6C and 7C, the end of the stirring member 15 near the support member is separated from the inner wall of the container main body, and collides against the retaining portion 24. The free end of the stirring member 15 further rotates in a direction of an arrow D2. Ink i further flows into the upper side of the stirring member 15 as indicated by an arrow F2.

Figure 6D:
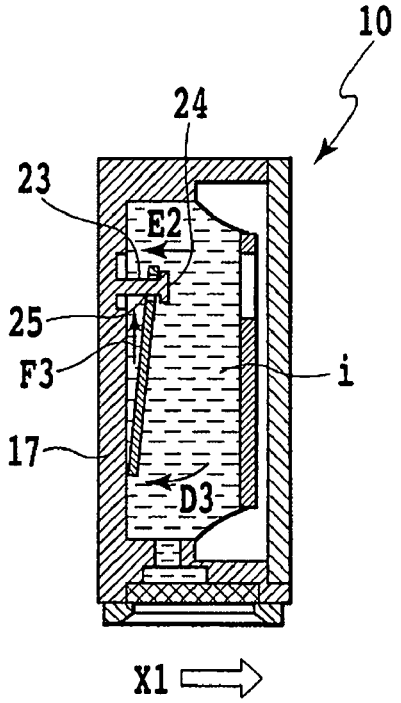
FIG. 6D is a cross-sectional view illustrating the operation of the stirring member when the movement direction of the ink tank changes.
Figure 7D:
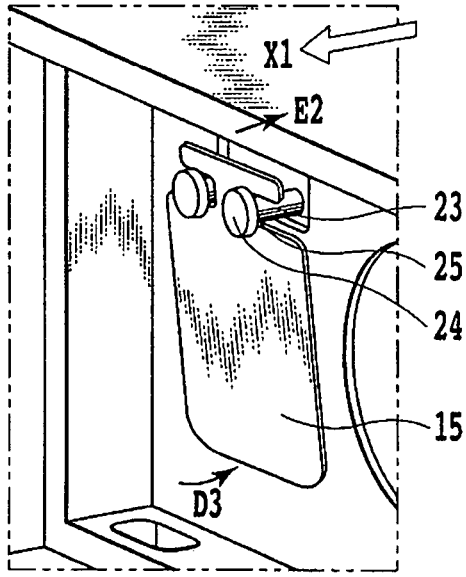
FIG. 7D is an enlarged perspective view illustrating the operation of the stirring member when the movement direction of the ink tank changes.

FIGS. 6D and 7D show a fourth state of the stirring member 15. The movement direction of the carriage 103 changes from the direction of the arrow X2 to the direction of the arrow X1 at the position corresponding to the printing width. With the inertial force at that time, the free end of the stirring member 15 first starts to move. That is, as shown in FIGS. 6D and 7D, the free end of the stirring member 15 rotates about the support member 23 in a direction of an arrow D3 and comes into contact with the inner wall of the container main body 17. Then, the end of the stirring member 15 near the support member moves in a direction of an arrow E2 along the shaft of the support member 23. The stirring member 15 approaches the inner wall of the container main body 17, and ink i interposed therebetween moves in a direction of an arrow F3.

Next to the fourth state of the stirring member 15, the first state shown in FIGS. 6A and 7A returns, and ink i moves in a direction of an arrow F4. In such a manner, the stirring member 15 repeats the first, second, third, and fourth states according to the reciprocation of the carriage 103.

As such, the stirring member 15 operates using the inertial force generated according to the reciprocation of the carriage 103 and stirs ink i. During the stirring operation, since frictional resistance is generated between the stirring member 15 and the support member 23, the free end of the stirring member 15 constantly moves precedingly, and then the end near the support member moves. This operation causes a pump effect, such that ink i in the ink containing chamber actively circulates up and down. Further, since the free end of the stirring member 15 that moves widely is located on a lower side in a vertical direction, the pigment components in ink that settle at the bottom of the ink containing chamber are easily stirred. As a result, ink in the entire ink containing chamber is efficiently stirred in combination with the above-described pump effect, and concentration of the pigment components can be reliably uniformized.

In this embodiment, the two stirring members 15 that perform the above-described basic operation are provided in the ink containing chamber. However, in this embodiment, the operations of the two stirring members 15 are slightly different.

FIGS. 8A to 8E are perspective views showing the essential parts, which illustrates the operations of two stirring members 15. In this embodiment, one of the two stirring members 15 has a thickness two times than that of the other stirring member such that a ratio of an inertial force according to the movement and resistance against ink i varies each other. In the following description, a thick and heavy-weight stirring member of the two stirring members 15 is referred to as a stirring member 15A, and a thin and light-weight stirring member is referred to as a stirring member 15B. The stirring members 15A and 15B may be disposed on either the left or right sides in FIG. 8A. Further, in this embodiment, the stirring members are formed of the same material but have different thicknesses in order to form the stirring members 15A and 15B having different weights, but the stirring members 15A and 15B may be formed of materials having different specific gravities.

Figure 9:
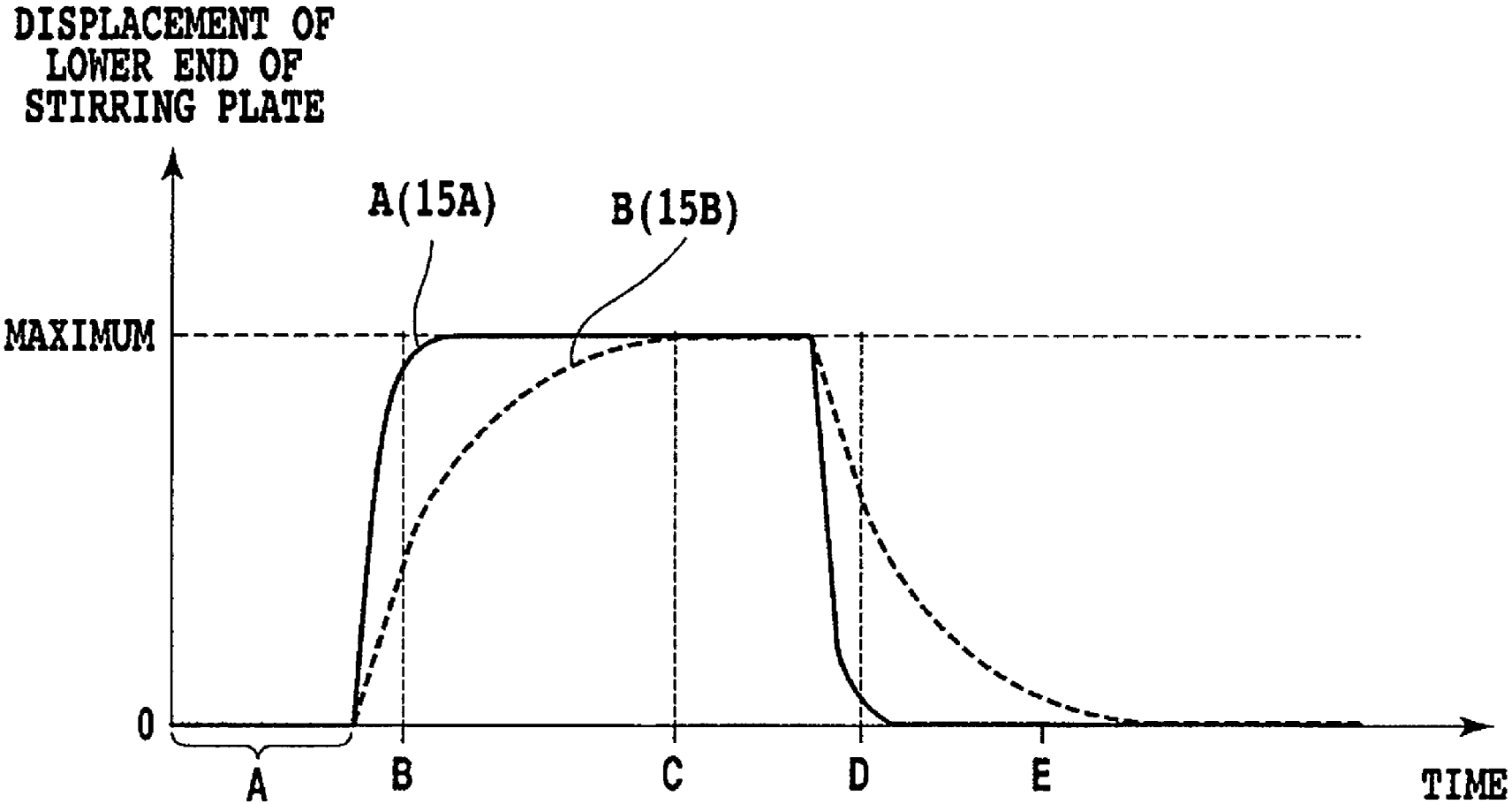
FIG. 9 is an operation characteristic curve of two stirring members.

FIG. 9 is a schematic view showing a time-lapse change of displacement of the free end, which illustrates operation timings of the two stirring members 15 (15A and 15B). A curve A is a displacement characteristic curve of the free end of the heavy-weight stirring member 15A, and a curve B is a displacement characteristic curve of the free end of the light-weight stirring member 15B.

Figure 8A:
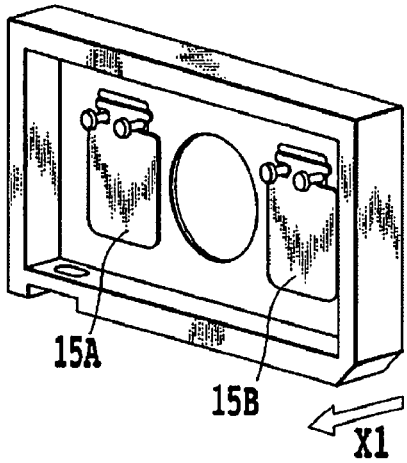
FIG. 8A is a perspective view of the inside of the ink tank, which illustrates the operations of two stirring members when the ink tank moves in one direction.

FIG. 8A shows the first states of the stirring members 15A and 15B (see FIG. 6A). At this time, the free ends of the stirring members 15A and 15B lie in a state corresponding to a period A of FIG. 9. That is, the ink tank 10 moves in the direction of the arrow X1 along with the carriage 103, and the stirring members 15A and 15B are pressed against the inner wall of the container main body 17 by the inertial force.

Figure 8D:
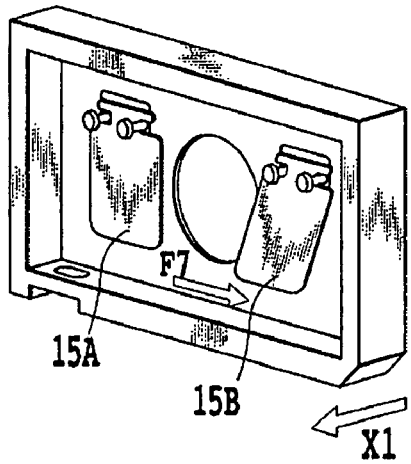
FIG. 8D is a perspective view of the inside of the ink tank, which illustrates the operations of two stirring members when the movement direction of the ink tank changes.
Figure 8B:
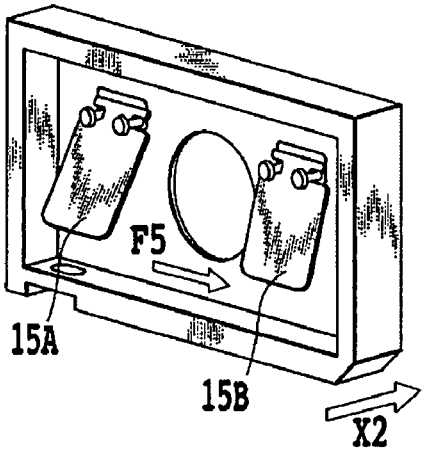
FIG. 8B is a perspective view of the inside of the ink tank, which illustrates the operations of two stirring members when the ink tank moves in the other direction.

FIG. 8B shows a state while the stirring members 15A and 15B are changing from the first state (see FIG. 6A) to the third state (see FIG. 6A). At this time, the free ends of the stirring members 15A and 15B lie in a state corresponding to a time B in FIG. 9. As described above, the movement direction of the carriage 103 is reversed at the position corresponding to the printing width, and the ink tank 10 starts to move in the direction of the arrow X2 along with the carriage 103. With the inertial force at that time, as shown in FIG. 6B, the free ends of the stirring members 15A and 15B start to rotate about the engagement portions with the support members 23 in the direction of the arrow D1. That is, the stirring members 15A and 15B become the second state.

At that time, the heavy-weight stirring member 15A is subject to an inertial force larger than the light-weight stirring member 15B does. For this reason, the free end of the stirring member 15A rotates against resistance of ink at a higher speed than the free end of the stirring member 15B. Meanwhile, since the inertial force acting on the light-weight stirring member 15B is smaller than the inertial force acting on the heavy-weight stirring member 15A, the free end of the stirring member 15B rotates at a lower speed than the free end of the stirring member 15A. Accordingly, at the time B in FIG. 9, while the heavy-weight stirring member 15A passes through the second state of FIG. 6B and is about to reach the third state of FIG. 6C, the light-weight stirring member 15B remains in the second state of FIG. 6B. As such, the movements of the stirring members 15A and 15B are different, and the flow of ink from the free end side of the heavy-weight stirring member 15A, which precedingly moves, toward the free end side of the light-weight stirring member 15B occurs in a direction of an arrow F5 of FIG. 8B.

Figure 8E:
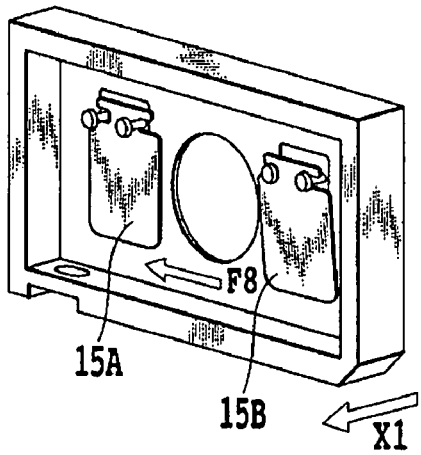
FIG. 8E is a perspective view of the inside of the ink tank, which illustrates the operations of two stirring members when the movement direction of the ink tank changes.
Figure 8C:
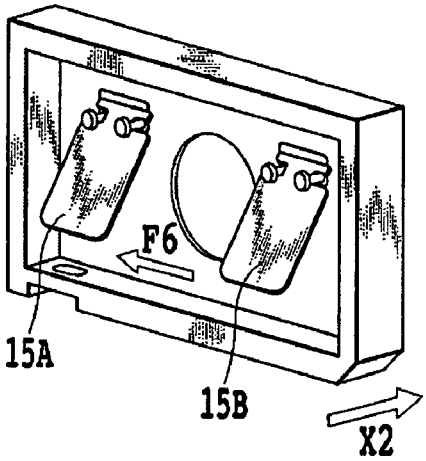
FIG. 8C is a perspective view of the inside of the ink tank, which illustrates the operations of two stirring members when the ink tank moves in the other direction.

FIG. 8C shows the third states of the stirring members 15A and 15B (see FIG. 6C). At this time, the free ends of the stirring members 15A and 15B lie in a state corresponding to a time C in FIG. 9. The heavy-weight stirring member 15A becomes the third state earlier than the light-weight stirring member 15B, and then the light-weight stirring member 15B becomes the third state. That is, the stirring member 15B moves even after the stirring member 15A reaches the third state and stops. With the movement of the stirring member 15B at that time, the flow of ink from the free end side of the stirring member 15B toward the free end side of the stirring member 15A occurs in a direction of an arrow F6 in FIG. 8C opposite to the direction of the arrow F5 in FIG. 8B.

FIG. 8D shows a state while the stirring members 15A and 15B are changing from the third state (see FIG. 6C) to the fourth state (see FIG. 6D). At this time, the free ends of the stirring members 15A and 15B lie in a state corresponding to a time D in FIG. 9. As described above, the movement direction of the carriage 103 is reversed at the position corresponding to the printing width, and the ink tank 10 starts to move in the direction of the arrow X1 along with the carriage 103. With the inertial force at that time, as shown in FIG. 6D, the free ends of the stirring members 15A and 15B start to rotate in the direction of the arrow D3.

At that time, the heavy-weight stirring member 15A is subject to an inertial force larger than the light-weight stirring member 15B does. For this reason, the free end of the stirring member 15A rotates against resistance of ink at a higher speed than the free end of the stirring member 15B. Meanwhile, since the inertial force acting on the light-weight stirring member 15B is smaller than the inertial force acting on the heavy-weight stirring member 15A, the free end of the stirring member 15B rotates at a lower speed than the free end of the stirring member 15A. Accordingly, while the heavy-weight stirring member 15A reaches the fourth state in a relatively short time, the light-weight stirring member 15B reaches the fourth state a little late. As such, the operations of the stirring members 15A and 15B are different, and the flow of ink from the free end side of the heavy-weight stirring member 15A, which precedingly moves, toward the free end side of the light-weight stirring member 15B occurs in a direction of an arrow F7 in FIG. 8D.

FIG. 8E shows a state while the light-weight stirring member 15B is reaching the fourth state after the heavy-weight stirring member 15A precedingly reaches the fourth state. At this time, the free ends of the stirring members 15A and 15B lie in a state corresponding to a time E in FIG. 9. The heavy-weight stirring member 15A becomes the fourth state earlier than the light-weight stirring member 15B, and then the light-weight stirring member 15B becomes the fourth state. That is, the stirring member 15B moves even after the stirring member 15A reaches the fourth state and stops. With the movement of the stirring member 15B at that time, the flow of ink from the free end side of the stirring member 15B toward the free end side of the stirring member 15A occurs in a direction of an arrow F8 in FIG. 8E opposite to the direction of the arrow F7 in FIG. 8D.

As such, in this embodiment, the stirring member performs the stirring operation of ink using the inertial force generated by the reciprocation of the carriage. In addition, the two stirring members have different weights and different inertial forces are applied to the two stirring members, such that a temporal difference occurs in the stirring operations of the two stirring members. Accordingly, with the temporal difference of the stirring operations, the flow of ink actively occurs in the movement direction of the carriage and in a direction crossing the movement direction of the carriage. Therefore, a stirring effect can be markedly improved.

In this embodiment, in order to generate the temporal difference of the stirring operations of the two stirring members, different inertial forces are applied to the two stirring members, and the stirring members are subject to a resistive force from ink at the substantially same area at the time of stirring operation. That is, when inertial moments of the two stirring members are Ia and Ib, and the area of a stirring surface of each of the two stirring members is S, ratios Ia/S and Ib/S are set different from each other, such that the temporal difference of the stirring operations of the stirring members is generated. Alternatively, the two stirring members may have different masses, such that ratios Ma/S and Mb/S of the masses Ma and Mb and the area S may be different from each other. With this configuration, when the stirring members move linearly along the support members, the movement timings of the stirring members can be different from each other.

Second Embodiment

Figure 10:
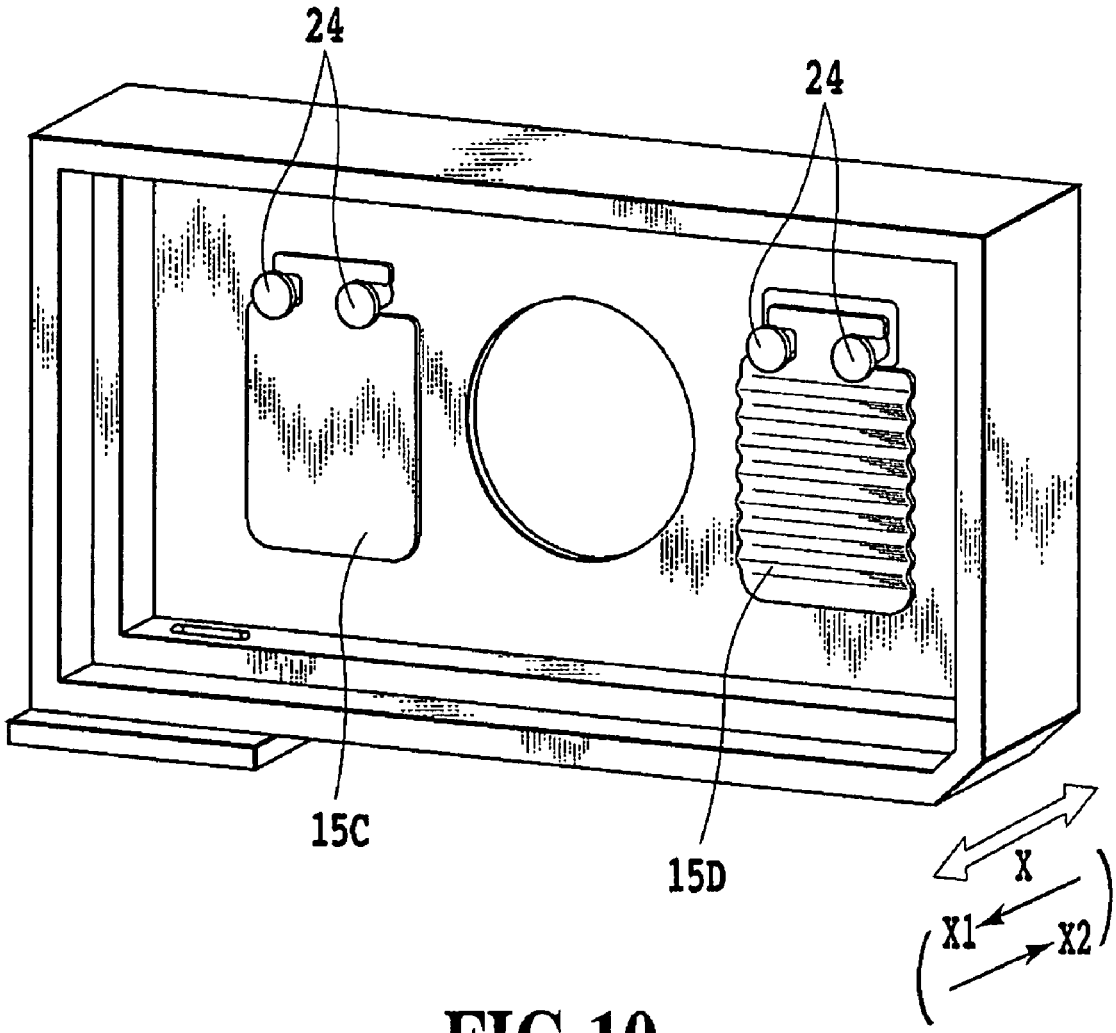
FIG. 10 is a perspective view of the inside of an ink tank, which includes two stirring members having different surface areas, according to a second embodiment of the invention.

FIG. 10 is a perspective view of the essential parts of an ink tank according to a second embodiment of the invention.

The ink tank of this embodiment includes two stirring members 15C and 15D substantially having the same weight and size. The inertial moments of the stirring members 15C and 15D are substantially the same. A stirring surface of the stirring member 15C is flat, and a stirring surface of the stirring member 15D is wavy to increase the surface area. Accordingly, during the stirring operation, the stirring member 15D is subject to resistance from ink larger than the stirring member 15C does. For this reason, when the areas of the stirring surfaces of the stirring members 15C and 15D are Sa and Sb, and the inertial moment of each of the stirring members 15C and 15D is I, ratios I/Sa and I/Sb are different from each other. Further, when the mass of each of the stirring members 15C and 15D is M, ratios M/Sa and M/Sb are different from each other.

Figure 13:
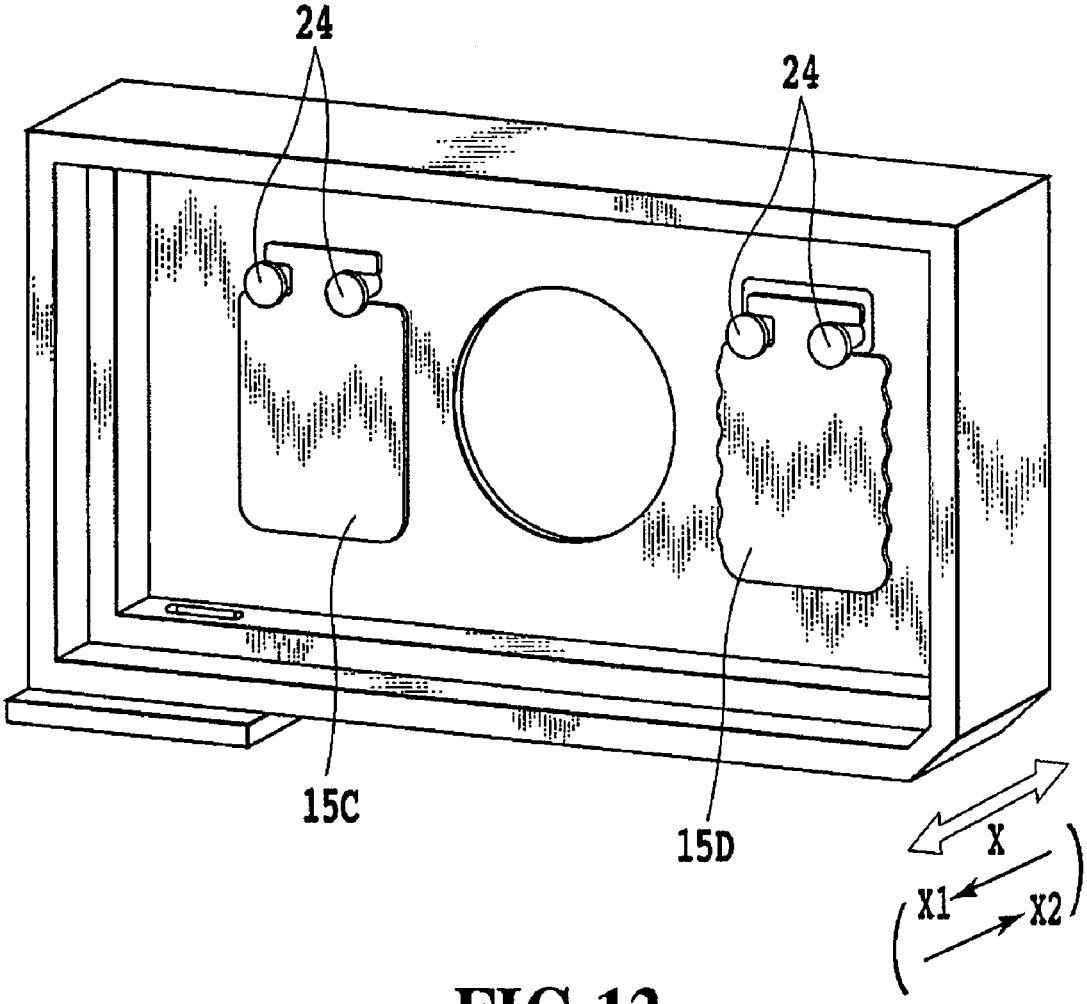
FIG. 13 is an explanatory view showing a case where two stirring members have different contour shapes.

In this embodiment, according to the movement of the carriage, the flat plate-shaped stirring member 15C precedingly moves, and then the wavy plate-shaped stirring member 15D moves late. As a result, similarly to the above-described embodiment, with the temporal difference of the stirring operations of the stirring members 15C and 15D, the active flow of ink occurs in the arrangement direction of the stirring members, that is, the directions of the arrows F5, F6, F7, and F8 in FIGS. 8B to 8E crossing the movement direction of the carriage. Therefore, similarly to the above-described embodiment, convection of ink can occur in the arrangement direction of the two stirring members, and thus stirring efficiency of ink can be markedly improved. In this embodiment, the two stirring members have the same weight but have different surface shapes, and thus the two stirring members have different surface areas. However, in order to make the surface areas of the stirring members different from each other, as shown in FIG. 13, the contour shapes of the stirring members may be different from each other.

Figure 14:
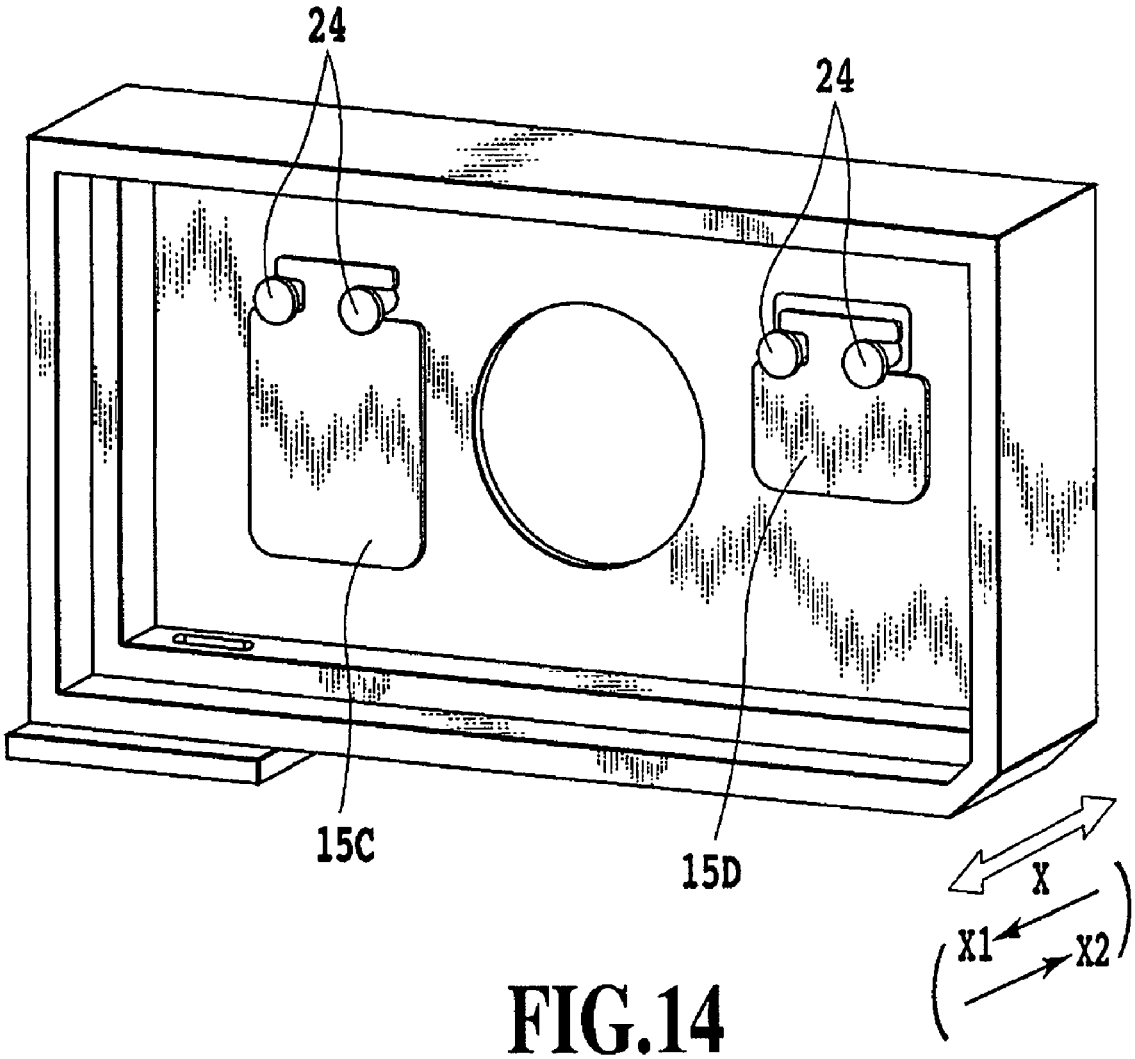
FIG. 14 is an explanatory view showing a case where two stirring members have different surface areas and weights.

FIG. 14 is an explanatory view showing a case where the configuration of the stirring members having different surface areas and the configuration of the stirring members having different weights are combined. In FIG. 14, the size of a stirring plate 15C is formed larger than a stirring plate 15D. Accordingly, the stirring plate 15C has the surface area and weight larger than the stirring plate 15D.

Other Embodiments

In the above-described embodiments, in order to shift the timings of the stirring operations of the two stirring members, the ratios of the inertial moment and the areas of the stirring surfaces of the stirring members are made different from each other, or the ratios of the masses and the areas of the stirring surfaces of the stirring members are made different from each other. However, the movement states of the stirring members may vary according to a difference in at least one of movement start time, movement speed, movement direction, movement distance, and movement trace. Further, in order to vary the movement states in such a manner, various mechanisms may be used. For example, examples of the mechanisms include a stopper or a guide mechanism that regulates the movement distances or the movement traces of the stirring members different from each other, or a mechanism that gives different movement resistance to the stirring members.

Figure 15A:
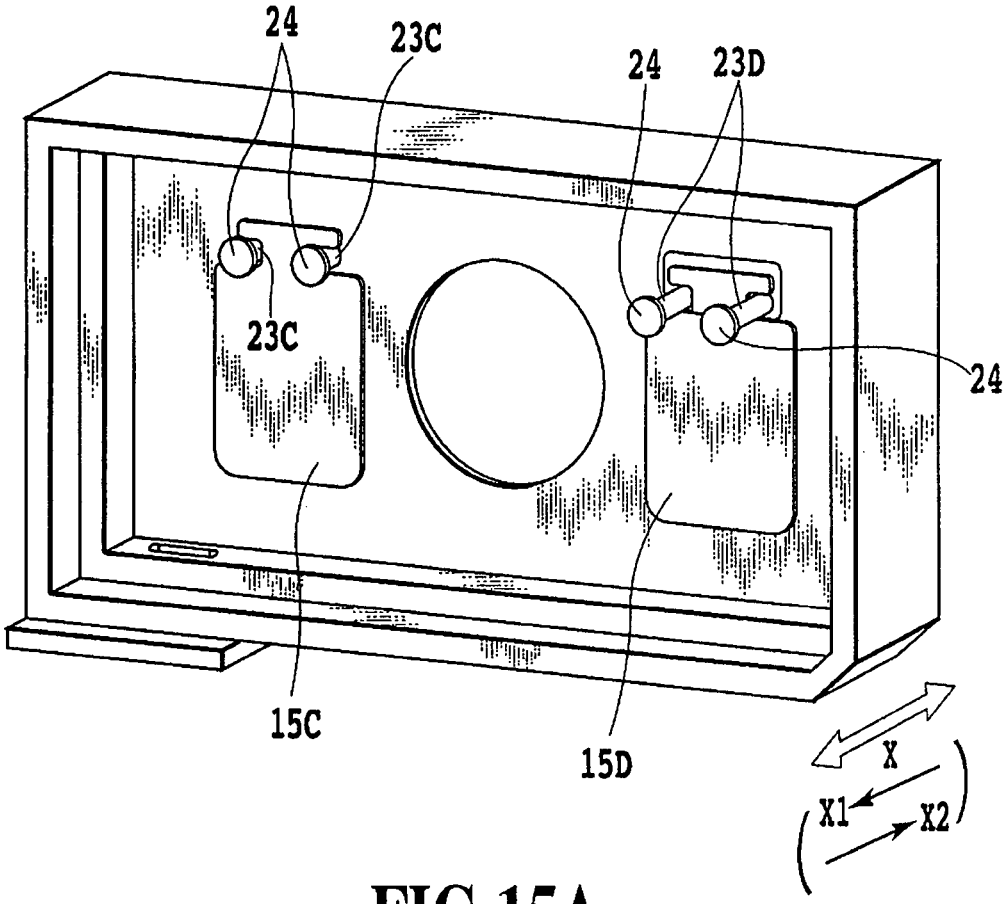
FIG. 15A is an explanatory view showing a case where support members for supporting two stirring members have different lengths.
Figure 15B:
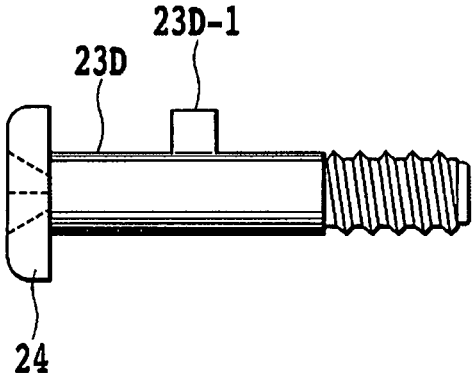
FIG. 15B is an explanatory view showing a case where a stopper is provided in a support member.
Figure 15C:
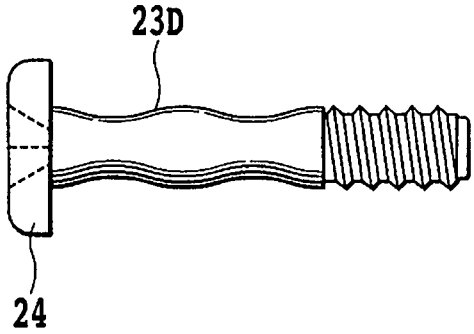
FIG. 15C is an explanatory view showing a case where the surface of a support member is curved.

Specifically, in order to make the movement distance of one stirring member relatively long and to make the movement distance of the other stirring member relatively short, as shown in FIG. 15A, a support member 23D of one stirring member may be formed longer than a support member 23C of the other stirring member. Further, in order to regulate the movement of one stirring member less than the movement of the other stirring member, as shown in FIG. 15B, a convex stopper portion 23D-1 may be provided in the support member 23D of one stirring member to regulate the movement of the corresponding stirring member. Further, in order to regulate the movement trace of one stirring member curvedly and to regulate the movement trace of the other stirring member linearly, as shown in FIG. 15C, the surface of the support member 23D of one stirring member may be curved. In addition, with a guide mechanism or the like, one stirring member may be moved dependently on the rotation and the other stirring member may be moved independently from the rotation.

In summary, what is necessary is that the flow of ink occurs from a position of one stirring member toward a position of the other stirring member by making the movement states of the two stirring members different from each other.

Figure 16:
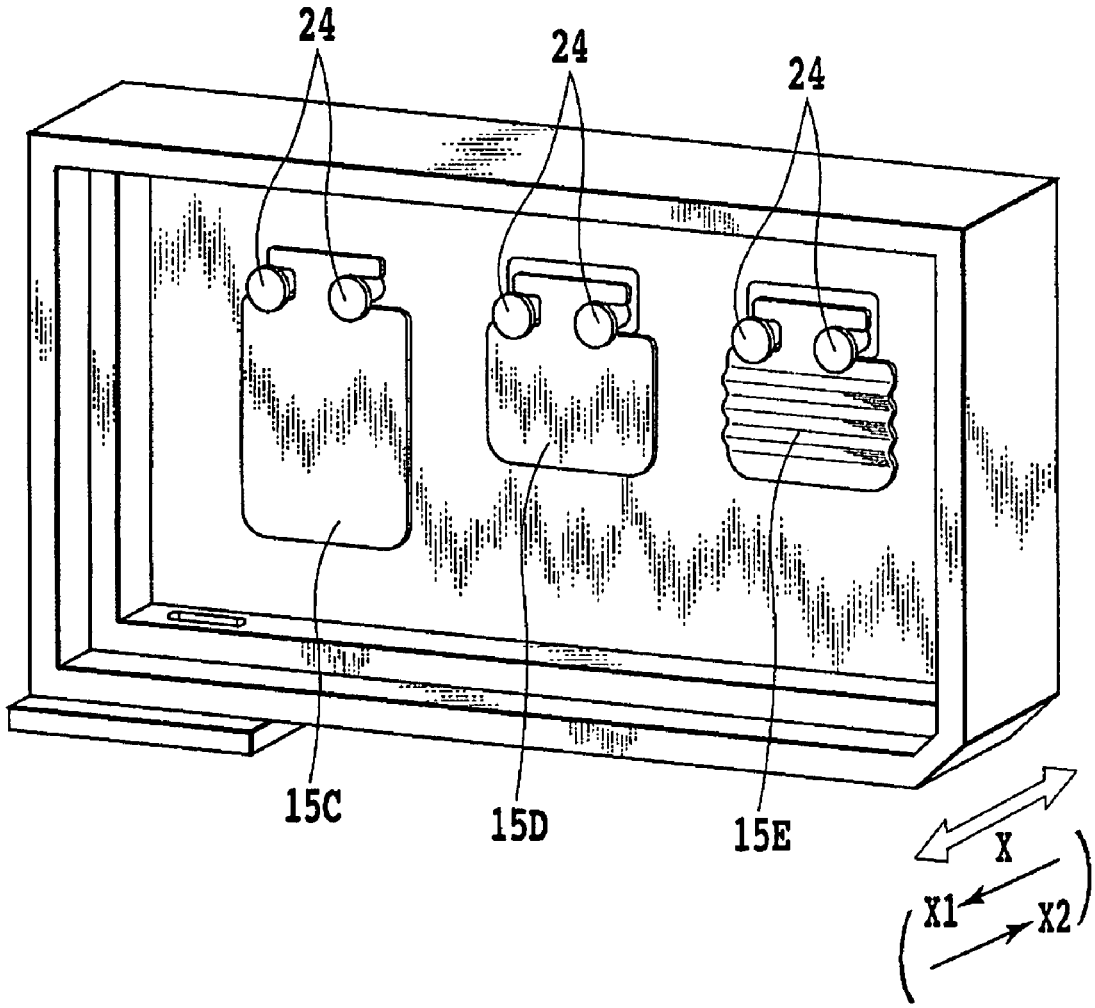
FIG. 16 is a perspective view of the inside of an ink tank that includes three or more stirring members.
Figure 17:
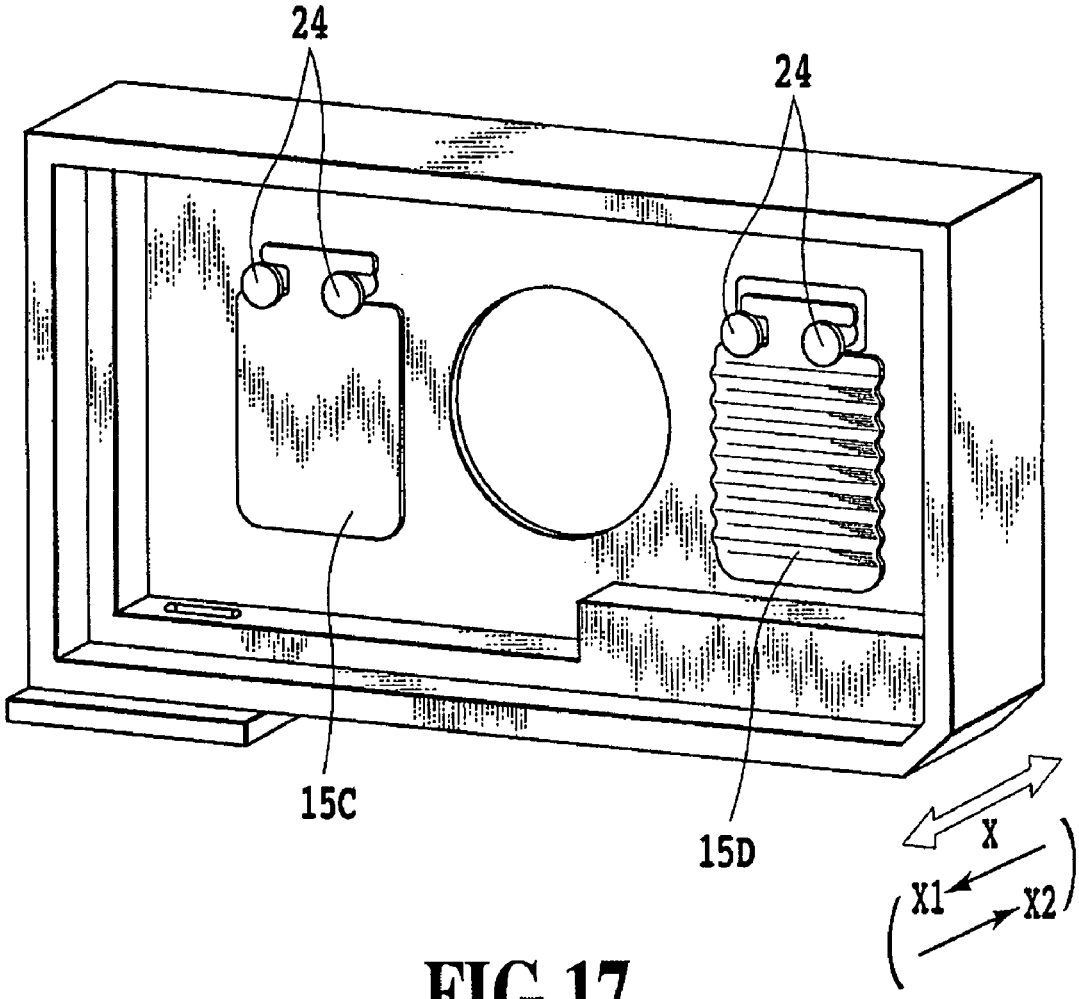
FIG. 17 is a perspective view of the inside of an ink tank when an ink containing portion has different shapes at positions where two stirring members are located.

Further, as shown in FIG. 16, three or more stirring members may be provided in the ink containing chamber, and the stirring members may have different weights or shapes. In this case, if adjacent stirring members among a plurality of stirring members have different inertial moments or weights, the flow of ink easily occurs between the stirring members. In addition, as shown in FIG. 17, the shapes of the stirring members and the shapes of the ink containing chamber at positions, where the stirring members are located, may be different from each other. The configuration that varies the movement states of the plurality of stirring members is not limited to the above-described embodiments. The invention can be widely applied as a container, which contains various liquids, other than the ink tank that contains ink. In addition, the invention can be widely applied to a printing apparatus that uses various printing heads ejecting ink on a printing medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-133048, filed May 11, 2006, which is hereby incorporated by reference herein in its entirety.

What is claimed is:

1. A liquid container that is detachably mounted on a carriage, which reciprocates in a direction crossing a feed direction of a printing medium, the liquid container comprising:

a case;

a liquid containing chamber that contains a liquid therein;

a plurality of support portions that is provided in the case to be arranged in the liquid containing chamber; and a plurality of stirring members, each of which has one end supported by a corresponding one of support portions and the other end as a free end, wherein at least two of the plurality of stirring members are arranged in a direction crossing a movement direction of the carriage, and at least two of stirring mechanisms, each of which has the support portion and the stirring member corresponding to the support portion, have different structures.

2. The liquid container according to claim 1, wherein the stirring members of the at least two stirring mechanisms have different surface areas in an application direction of an inertial force according to the movement of the carriage.

3. The liquid container according to claim 1, wherein the stirring members of the at least two stirring mechanisms have different distances from support positions by the corresponding support portions to lowermost surfaces thereof in a gravity direction.

4. The liquid container according to claim 1, wherein the stirring members of the at least two stirring mechanisms have different masses.

5. The liquid container according to claim 1, wherein the plurality of stirring members move along the corresponding support portions according to the movement of the carriage.

6. The liquid container according to claim 5, wherein the plurality of stirring members move different distances along the corresponding support portions.

7. The liquid container according to claim 1, wherein the liquid is ink.

8. The liquid container according to claim 7, wherein the ink is ink that contains a pigment component.

9. A liquid container that is detachably mounted on a carriage, which reciprocates in a direction crossing a feed direction of a printing medium, the liquid container comprising:

a case;

a liquid containing chamber that contains a liquid therein;

a supply port that supplies the liquid in the liquid containing chamber to the outside;

support portions that are provided in the case to be arranged in the liquid containing chamber; and a plurality of stirring members, each of which has one end supported by a corresponding one of support portions and the other end as a free end, wherein at least two of the plurality of stirring members are arranged in a direction crossing the moving direction of the carriage, and when an inertial moment to be applied to each of the stirring members according to the movement of the carriage is In and a maximum surface area of each of the stirring members subject to an inertial force is Sn, at least two stirring members have different ratios In/Sn.

10. A liquid container that is detachably mounted on a carriage, which reciprocates in a direction crossing a feed direction of a printing medium, the liquid container comprising:

a case;

a liquid containing chamber that contains a liquid therein;

a supply port that supplies the liquid in the liquid containing chamber to the outside;

support portions that are provided in the case to be arranged in the liquid containing chamber; and a plurality of stirring members, each of which has one end supported by a corresponding one of the support portions and the other end as a free end, wherein at least two of the plurality of stirring members are arranged in a direction crossing the moving direction of the carriage, and at least two of the plurality of stirring members have different movement states according to an inertial force.

11. The liquid container according to claim 10, wherein the movement states of the at least two stirring members are different in view of at least one of a movement start time, a movement speed, a movement direction, a movement distance, and a movement trace.

* * * * *